US006361374B1

(12) United States Patent
Lloyd et al.

(10) Patent No.: US 6,361,374 B1
(45) Date of Patent: Mar. 26, 2002

(54) CONNECTOR MODULE RETAINER ESPECIALLY SUITABLE FOR WAFER CONNECTORS AND CONNECTOR ASSEMBLY UTILIZING SAME

(75) Inventors: Keith Lloyd, Maumelle, AK (US); Michael F. Magajne, Cicero; Kent E. Regnier, Lombard, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/515,133

(22) Filed: Feb. 29, 2000

(51) Int. Cl.[7] ..... H01R 13/502; H01R 13/514; H01R 13/648

(52) U.S. Cl. ..... 439/701; 439/608

(58) Field of Search ..... 439/701, 608, 439/716

(56) References Cited

U.S. PATENT DOCUMENTS 3,496,521 A * 2/1970 Hohorst ..... 339/95
4,171,861 A * 10/1979 Hohorst ..... 439/94
4,735,583 A * 4/1988 Rudy, Jr. et al. ..... 439/350
4,984,992 A * 1/1991 Beamenderfer et al. .... 439/108
5,090,920 A * 2/1992 Casey ..... 439/540.1
5,122,077 A * 6/1992 Maejima et al. ..... 439/398
5,385,490 A * 1/1995 Demeter et al. ..... 439/579
5,795,191 A * 8/1998 Preputnick et al. ..... 439/608
6,027,380 A * 2/2000 Hanning et al. ..... 439/716

* cited by examiner

*Primary Examiner*—P. Austin Bradley
*Assistant Examiner*—Edwin A. León
(74) *Attorney, Agent, or Firm*—A. A. Tirva; Thomas D. Paulius

(57) ABSTRACT

A retainer and connector system serves to reliably hold together and align a series of thin connector modules, such as wafer connectors, into an overall unit formed from the individual connector modules. The side edges of each of the connector modules have a pair of cavities formed therein. A retainer member is provided having a length equal to the thickness of the connector unit. The retainer member has first and second engagement members disposed thereon. Both engagement members may be inserted into the cavities to hold the connectors together as a stack, or one set of engagement members may be inserted into a set of the cavities and the retainer member rotated to align the connector modules together and then the other set of engagement members may be pressed into engagement with another set of cavities.

13 Claims, 7 Drawing Sheets

CONNECTOR MODULE RETAINER ESPECIALLY SUITABLE FOR WAFER CONNECTORS AND CONNECTOR ASSEMBLY UTILIZING SAME

BACKGROUND OF THE INVENTION

The present invention relates generally to connectors and multiple-unit connector assemblies, and more particularly, to a retainer for aligning and maintaining a plurality of connector modules, such as wafer connectors, together as a unit.

In the field of telecommunications and in other electronic fields, cable assemblies are used to connector one electronic device to another. In many instances, the cable assemblies have at one or more of their ends, a plurality of connector modules, each of which serves to connect a plurality of individual wires to an opposing connector, such as a pin connector. It is desirable to somehow connect the individual connector modules together so that they may connected and disconnected from an opposing connector as a single unit, in order to save in time in making the connections, as well as for other reasons.

Structures for attaining these aims are known in the art, but tend to be large and bulky as compared to the overall size of the connector modules. Such structures are shown in U.S. Pat. No. 5,385,490, issued Jan. 31, 1995 in which a two-part retainer is used. The two part retainer in this patent surrounds the entire exterior surface of the connector modules and thus increases the overall size of the connector modules, when assembled together as a unit inside of the retainer. This may force the use of a different design for the opposing connector which the unit of connector modules are intended to engage. A similar retainer housing is described in U.S. Pat. No. 4,984,992, issued Jan. 15, 1991. This retainer also defines a hollow interior into which a plurality of connector modules are inserted. The retainer surrounds the exterior surfaces of the connector modules and therefore increases the overall size and mass of the connector module unit significantly.

Still other retainer mechanisms, such as that shown in U.S. Pat. No. 5,997,361 have a complex structure that engages both a header containing a series of wafer connectors and a pin header into which the connectors are inserted. This requires modification of the header and the shroud containing the wafer connectors. Such a construction does not incorporate any means for aligning the connectors together into a stack where each connector has a certain, predetermined position.

The present invention is therefore directed to a novel and unique retainer assembly for use with a plurality of connector modules, preferably wafer connectors, that does not increase the overall size of the unit of connector modules and which reliably aligns the connector modules together and maintains them in a unitary fashion.

SUMMARY OF THE INVENTION

Accordingly, it is a general object of the present invention to provide an improved retainer for use with forming a unit of a plurality of connector modules that aligns the connector modules and maintains them in a particular orientation within the unit.

Another object of the present invention is to provide a retainer for holding a series of connector modules such as wafer connectors together as a unit, by engaging the exterior surfaces of the wafer connectors without increasing the overall size of mass of the unit of connectors.

Yet another object of the present invention is to provide a retainer for aligning and holding together, a plurality of thin connector modules together wherein the retainer has two opposing engagement ends that engage two different portions of the wafer connectors and which is insertable into one set of cavities formed on the exterior surfaces of the connector modules and rotatable when engaged in order to exert a alignment effort on the connector modules and in order to bring the other end of the retainer into engagement with another set of cavities also formed on the exterior surfaces of the connector modules.

A still further object of the present invention is to provide a retainer, or stiffener, that is used to hold a plurality of high speed cable connectors together by way of engaging the individual cable assembly connectors, each of the connectors having two engagement cavities formed along at least one side thereof, the engagement cavities being spaced apart from each and the retainer having a length that is approximately equal to the spacing between the cavities, the retainer further having two opposing engagement ends, a first engagement end thereof have a rounded engagement member that is insertable into a corresponding first engagement cavity of the connector and a second engagement end that is insertable into and engageable with a corresponding second engagement cavity of the connector, the first engagement end being rotatable within the connector first engagement cavity.

Another object of the present invention is to provide a retainer that engages a plurality of wafer-style connectors together as a unit, the retainer having at least a pair of engagement legs that are received within corresponding recesses in the sides of the wafer connectors in a snap-locking type arrangement, the engagement legs aligning and maintaining the connectors together widthwise of the unit and the retainer having secondary means for engaging the connectors and aligning them lengthwise along the unit.

The present invention accomplishes these and other objects by way of its unique structure. In a first embodiment of the invention, a retainer member is provided that has a length equal to a corresponding width of the assembly of connectors and it includes a plurality of individual retaining elements formed on it, each individual retainer element being positioned in order to engage the exterior surface of a corresponding individual connector. The retainer member, in this embodiment, takes the form of an elongated member having two opposing engagement ends or edges that extend lengthwise of the retainer member and which engage two corresponding engagement portions disposed on each individual connector module, which in the preferred embodiment, take the form of engagement cavities.

The two engagement ends of each retainer element are differently configured. One engagement end of each retainer element is partially rounded and is adapted to fit into a semi-circular cavity formed on each connector and the engagement end includes a outstanding shoulder portion that is adapted to engage with a corresponding opposing shoulder, or stop portion formed in the semi-circular engagement cavity. The rounded profile of the engagement end and the semi-circular profile of the engagement cavity cooperatively permit the first engagement end to be inserted and rotated within the first engagement cavity of the connectors. This action exerts a slight alignment force on all of the connector elements to align them as a block and facilitates the engagement of the retainer member second end into the connector element second engagement cavities.

The second engagement cavity formed on each connector element includes a generally rectangular cavity having an undercut formed therein that defines another shoulder or stop. The second engagement end of the retainer member includes a flexible latch member having a latching hook formed thereon in opposition to the stop of the second engagement cavity. Thus, when the retainer member is rotated after insertion into the first engagement cavity, the latching end is urged into the second engagement cavity and into engagement with the stop therein.

The round configuration of the retainer member first end permits the retainer member to be initially located in the first engagement cavities and then rotated. The rotational movement serves to align the plurality of connector elements lengthwise of the connector elements, while lugs that may be formed in the one or both of the two engagement cavities of the connector elements may be engaged by corresponding opposing slots formed in the engagement ends of the retainer member so that the connector elements are thereby aligned in widthwise of the connector elements, and transverse to the lengthwise direction.

In a second embodiment of the invention, the retainer has at least one pair, and preferably two pairs, of engagement legs that fit into corresponding recesses formed on the body portions of the wafer connectors in an interference, or snap-fit engagement. The wafer connectors may also include positioning legs that are received within recesses formed in the retainer. These legs serve to align all of the wafer connectors together in a general manner while the engagement legs of the retainer provide a primary means of retention. These legs may be fashioned as rails with pairs of prongs that engage undercut portions of the wafer connector recesses. The prongs may extend out from the retainer at a slight angle so that they will flexibly deflect to facilitate the insertion of them into the wafer connectors.

In still another embodiment, the wafer connectors may be provided with a series of recesses that receive corresponding associated posts that are formed as part of and extend from the retainer. These recesses, and the aforementioned posts cooperate with the retainer engagement legs to hold the stack of connectors together without the need for engaging the pin header, as in the prior art.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENTS

Figure 1:
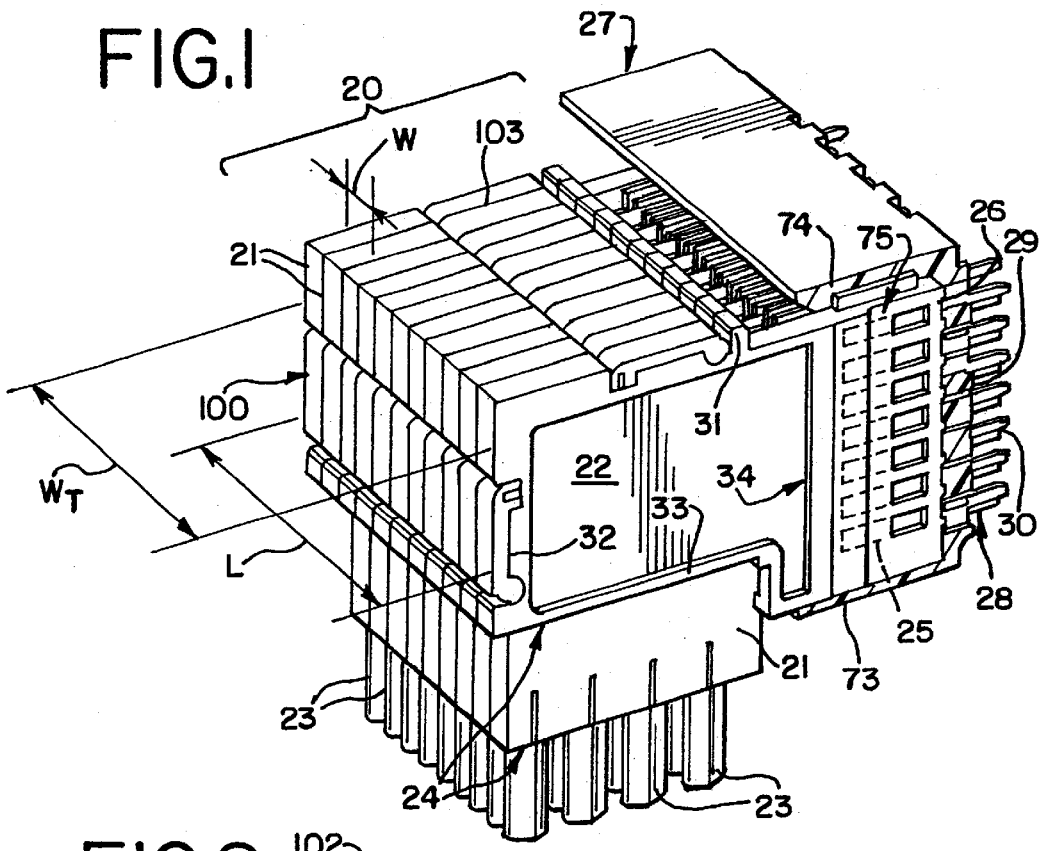
FIG. 1 is a perspective view of a wafer connector assembly utilizing a retainer member constructed in accordance with the principles of the present invention.

FIG. 1 illustrates a connector assembly 20 in the form of a "block" or "unit" that is made up of a plurality of individual connector elements, or modules 21. Each such connector element 21 has a relatively thin connector body 22, and hence the name "wafer" connector has been commonly applied to such connector elements in the art. Each connector element 21, as is known in the art, has a connector body 22 through which conductive elements (not shown) extend in order to provide conductive paths between individual connector cables 23 disposed at one end 24 of the connector element 21, each of which typically contains a pair of conductive wires, and a like number of conductive terminals 25 (shown in phantom) that are typically embedded in another end 26 of the connector element 21 spaced apart from the cable end 24 of the connector element 21. This engagement, or terminal end 26, is typically received within an opposing connector member 27, such as a pin header, that is typically mounted to a backplane (not shown). The opposing connector member 27 typically has a plurality of conductive pin terminals 28 that extend on both sides of a base 29 of the opposing connector body, certain ends 30 of which are received within corresponding openings in the backplane member and the other ends of which are received within openings formed in the terminal ends 26 of the connector elements 21 and which engage the interior terminals 25 thereof. Each connector element 21 may be considered as having a number of distinct sides, faces or edges with four such sides 31, 32, 33 & 34 being shown in FIG. 1.

It is important to retain the connector elements 21 together in alignment, as a single unit, or block, of connector elements 21 in order to facilitate the insertion thereof into an opposing connector member 27 and connection of the conductive terminals 25 to opposing terminals 28. The small size of these type of connector elements and the tolerances involved in making their conductive terminals 25 are some of the reasons why alignment of such wafer connector assemblies is important, because when aligned, it is easier to insert and connector an aligned assembly without fear of misalignment of the terminals or wafer connector elements.

The present invention provides a simple, reliable and inexpensive means for aligning a series of wafer, or other connector elements that may be trimmed to an appropriate size to match the corresponding size of an assembly 20 of wafer connector elements 21 by an installer, and which aligns and retains a plurality of wafer connector elements 21 together as a single mass in a preselected spacing. This is accomplished by way of a connector retainer member 100 that engages the plurality of wafer connector elements 21. As illustrated in FIG. 1, the retainer members 100 of the present invention may be used on two distinct, but adjacent, sides 31, 32 of the wafer connector assembly 20, although other constructions are contemplated, such as the use of a single retainer member 100 or two such retainer members 100 being used along one side of the wafer connector element 21, or the cables 23 of the connector elements being oriented along one side 32 opposite the terminal end 34 of the connector elements 21 and the retainer members 100 being used on the two remaining opposing sides 31 & 33 of the connector elements 21.

Figure 2:
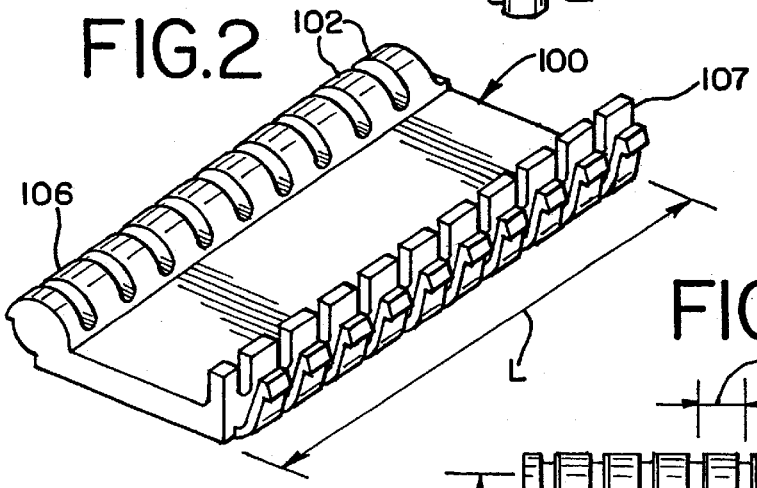
FIG. 2 is a perspective view of a retainer member illustrated in FIG. 1, and taken from the underside thereof.
Figure 3:
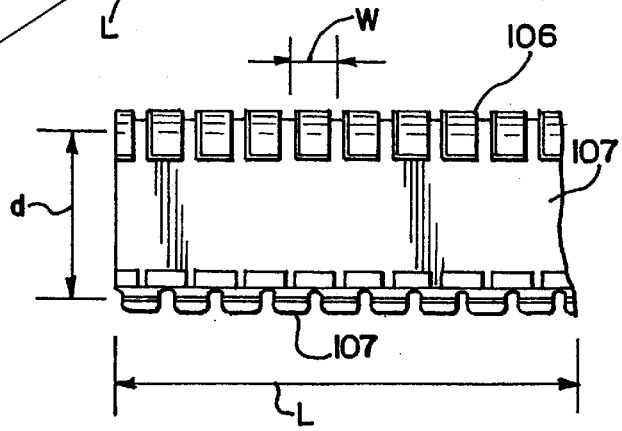
FIG. 3 is a bottom plan view of the retainer member of FIG. 2.
Figure 5:
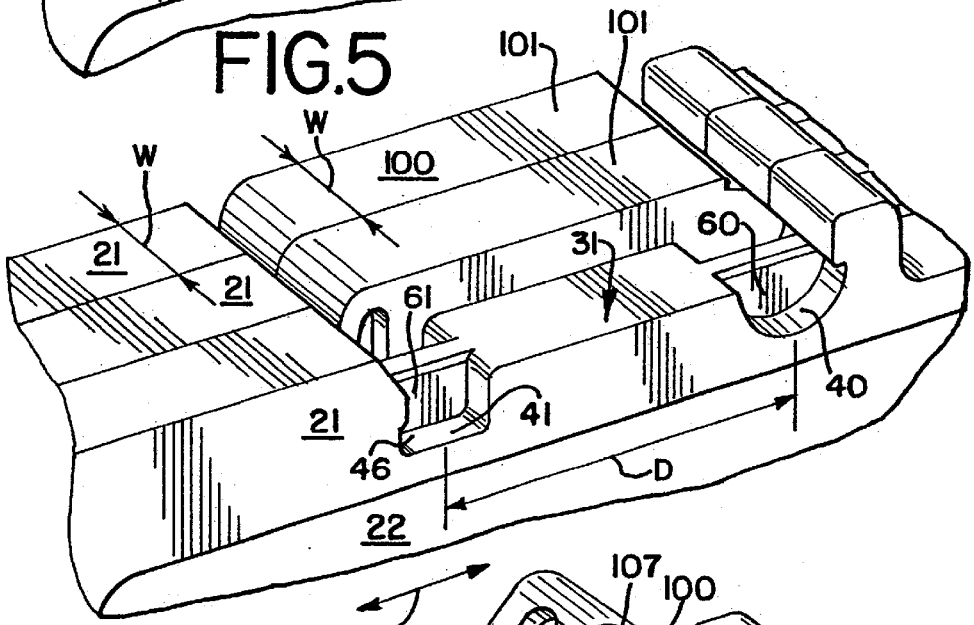
FIG. 5 is a view similar to FIG. 4, but illustrating a retainer member in place thereon with one of the retainer elements at the end of the retainer member removed for clarity.

As shown in FIGS. 2 & 3, the retainer member 100 includes an elongated member 101 having a preselected length L, and which may be considered as incorporating therein, a plurality of individual retainer elements 102, with each retainer element 102 having a preselected width W (FIGS. 3 & 5) that preferably corresponds to the width w (FIG. 1) of the connector element 21. The individual retainer elements 102 that make up the overall retainer member 100 may be separated from each other by a series of intervening indentations 103 so as to facilitate trimming the retainer member 100 when assembling it to a connector assembly 10 in order to match the overall width of the connector assembly 10. These indentations are preferably of a depth that will not weaken the structural integrity of the retainer member 100, but are sufficiently deep to facilitate the trimming of a retainer member 100 by an installer.

Turning now to FIG.2, the retainer member 100 can be seen to have two opposing end portions 106, 107 that run lengthwise of the retainer member 100 and which are separated and interconnected by an intervening body portion 108. One end portion 106 serves as a pivoting end and the other end 107 serves as a latching end that holds the retainer member in place on the connector assembly 20. The length L of the retainer member 100 will typically correspond to the overall width WT of the connector assembly 20.

Figure 4:
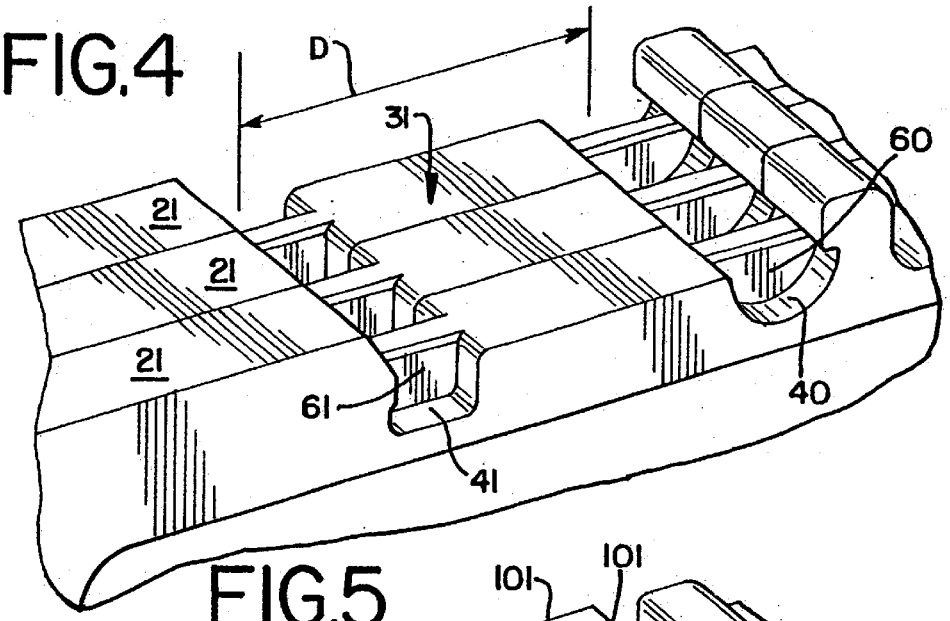
FIG. 4 is an enlarged, detail view of the edge of a portion of the wafer connector assembly illustrating the engagement portions disposed thereon that are engaged by the retainer member of the present invention.

FIG. 4 illustrates one edge 31 of a series of individual connector elements 21 and how the edges 31 of the connector elements 21 are modified to accommodate the retainer member 100. Two different engagement portions 40,41 are disposed on the edges 31 of the connector elements 21 and are illustrated as cavities that are formed in the connector body portion 22 of each connector element 21. The engagement cavities 40, 41 are spaced apart from each other a predetermined distance D that corresponds to a distance between the end portions 106, 107 of the retainer member 100.

Figure 8:
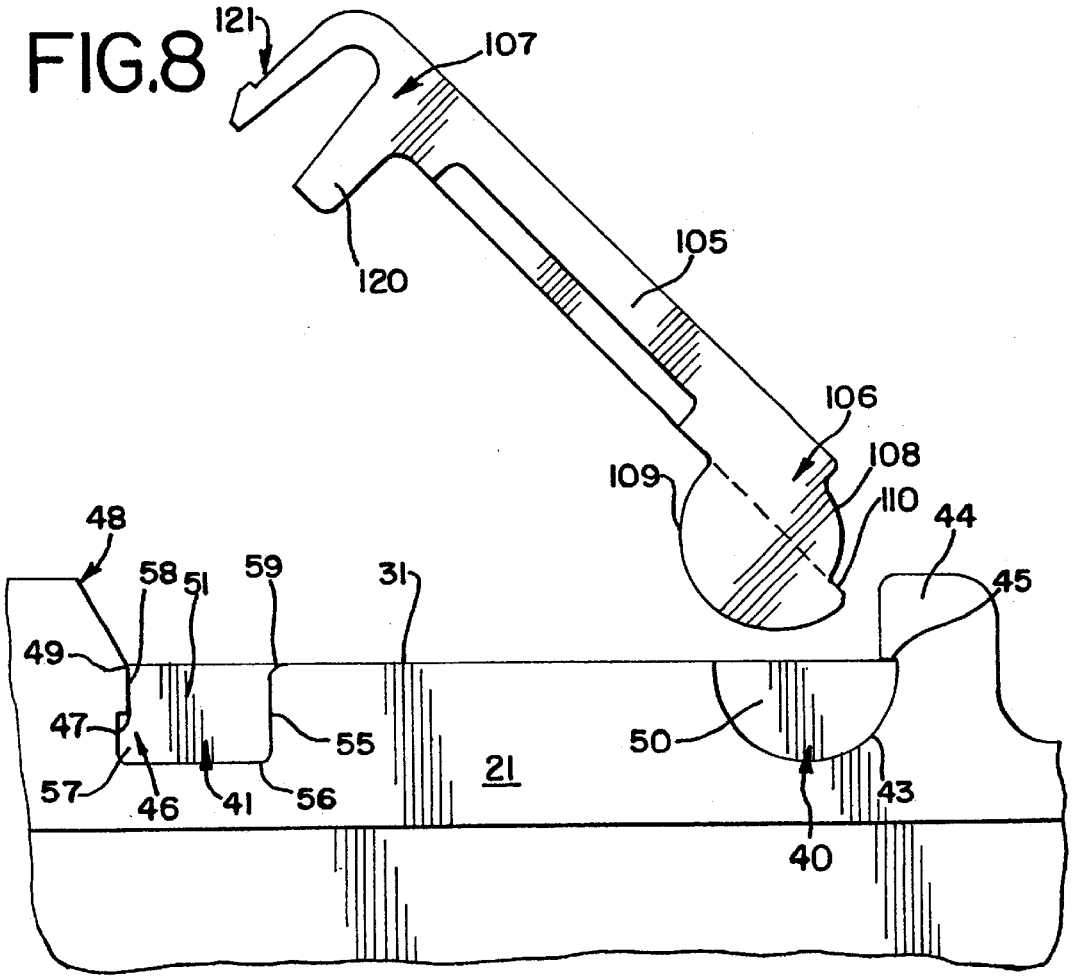
FIG. 8 is an enlarged detail view, taken in elevation, of the retainer element of FIG. 7 and a connector illustrating how the retainer member is inserted into one of the engagement portions of the connector.

FIG. 8 best illustrates the two engagement cavities 40, 41 and their particular structure. The first engagement cavity 40 is rounded, with a generally semi-circular profile defined by a curved sidewall 43 that extends beneath the side edge 31 of the connector element 21. A post portion 44 extends from connector body past the level of the side edge 31 and a portion 42 of the first engagement cavity 40 undercuts the post portion 44 to form a stop surface 45 that faces into the first engagement cavity 40, the purpose of which shall be explained in greater detail below.

The second engagement cavity 41 has an overall rectangular configuration and is also formed in the connector body portion 22. This cavity 41, as with the first engagement cavity 40, also opens along the side edge 31 of the connector element body portion 22. It also has an undercut portion 46 that defines a stop surface 47 that faces into the engagement cavity 41 and which is engaged by the second end 107 of the retainer member 100. The far sidewall 48 of the cavity 41 may have a ramped surface 49 for interacting with the corresponding engagement end 107 of the retainer member 100. Each of the engagement cavities 40, 41 may further have formed therein, a central wall or lug 50, 51, that is preferably centrally disposed therein and which are engaged by the retainer member 100 in the manner described in greater detail below.

Figure 7:
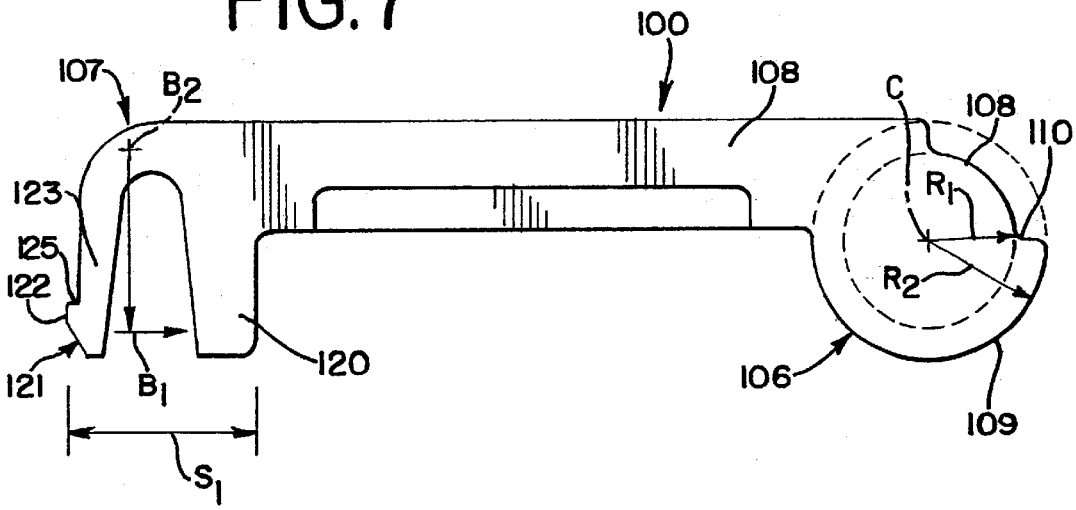
FIG. 7 is an elevational view of one end of the retainer member of FIG. 1.

The retainer member ends 106, 107 are specially configured to engage and interact with the engagement cavities 40, 41 of the connector elements 21. The first end 106 of the retainer member 100, as illustrated in FIG. 7, forms what may be aptly termed as a "pawl" portion that has an overall rounded configuration with two distinct, inner and outer curved surfaces 108, 109 disposed thereon. Each such surface 108, 109 has a distinct radius $R_1$, $R_2$ associated with it from the center point C of the pawl 106 with the radius of the outer surface 109 being greater than the radius of the inner surface 108. This difference in radii defines a shoulder, or stop edge 110, in the pawl portion 106 of the retainer which opposes the shoulder 45 of the first engagement cavity 40 of the connector element 21 and which interconnects the two curved surfaces 108, 109 together.

With this structure, the engagement end 106 is easily insertable into the first engagement cavity 40 and the two curved surfaces 109, 43 permit rotation of the pawl end 106 in the cavity 40. This rotation occurs until the stop edge 110 of the pawl end abuts the stop surface 45. At this full extent of rotation, the second end 107 of the retainer member 100 is itself inserted into its corresponding and opposing second engagement cavity 41.

As seen in FIG. 7, the second engagement end 107 includes two members 120, 121 that extend out from the body portion 105 of the retainer member 100 in a cantilevered fashion. These two members 120, 121 may be considered as flexible members having respective free ends that are spaced apart from each other in a first predetermined spacing $S_1$. The one member 120 acts as an engagement lug that enters the second engagement cavity 41 to engage the adjacent and opposing surface 55 of the cavity 41. This engagement is in the nature of a "press fit". The engagement of the second engagement end 107 is assisted by a latching member 121.

This latching member 121 is spaced apart from the lug member 120 by the spacing $S_1$ (FIG. 7) and has a body portion 123 that is relatively thin as compared to the thickness of the lug member 120 and thus is more flexible in nature. This spacing $S_1$ is greater than the spacing $S_2$ between the two sidewalls 55, 58 of the second engagement cavity 41 so that when the second engagement end 107 is inserted into the second cavity 41 the latch member 121 is flexed toward the lug member 120 in the direction of the arrow "$B_1$" in FIG. 7. This flexing is somewhat like a pivoting action where the free end of the latching member 121 pivots about a point $B_2$. The latching member 121 preferably has an engagement member, illustrated in FIGS. 7–10, as a hook 122 that protrudes out from the body portion 105 and itself has an engagement surface 125 that faces upwardly with respect to the second cavity 41. The cavity 41 includes an overhanging portion 49 with an engagement shoulder or surface 47 formed thereon that opposes the bottom of the cavity 41.

Figure 6:
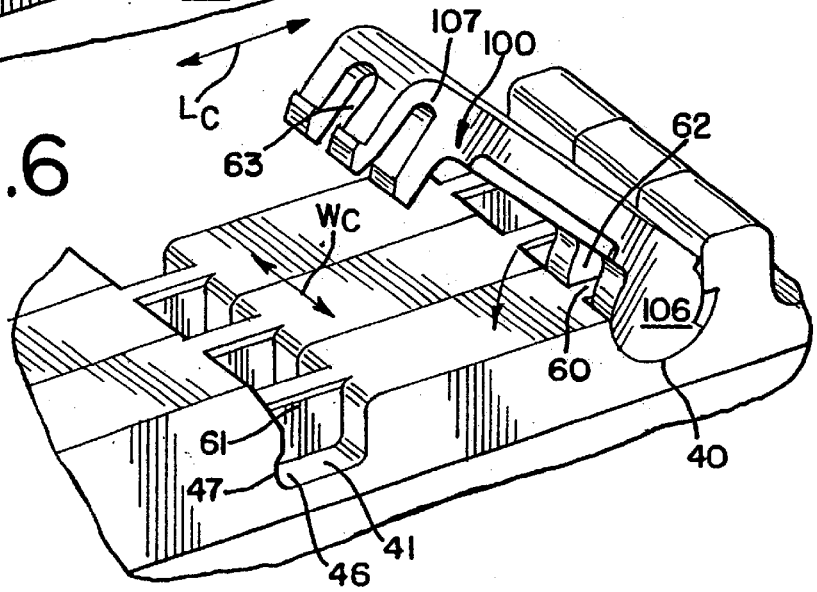
FIG. 6 is a view similar to FIG. 4, but illustrating the insertion of and engagement by one end of a retainer element with one of the engagement portions of an individual connector.
Figure 9:
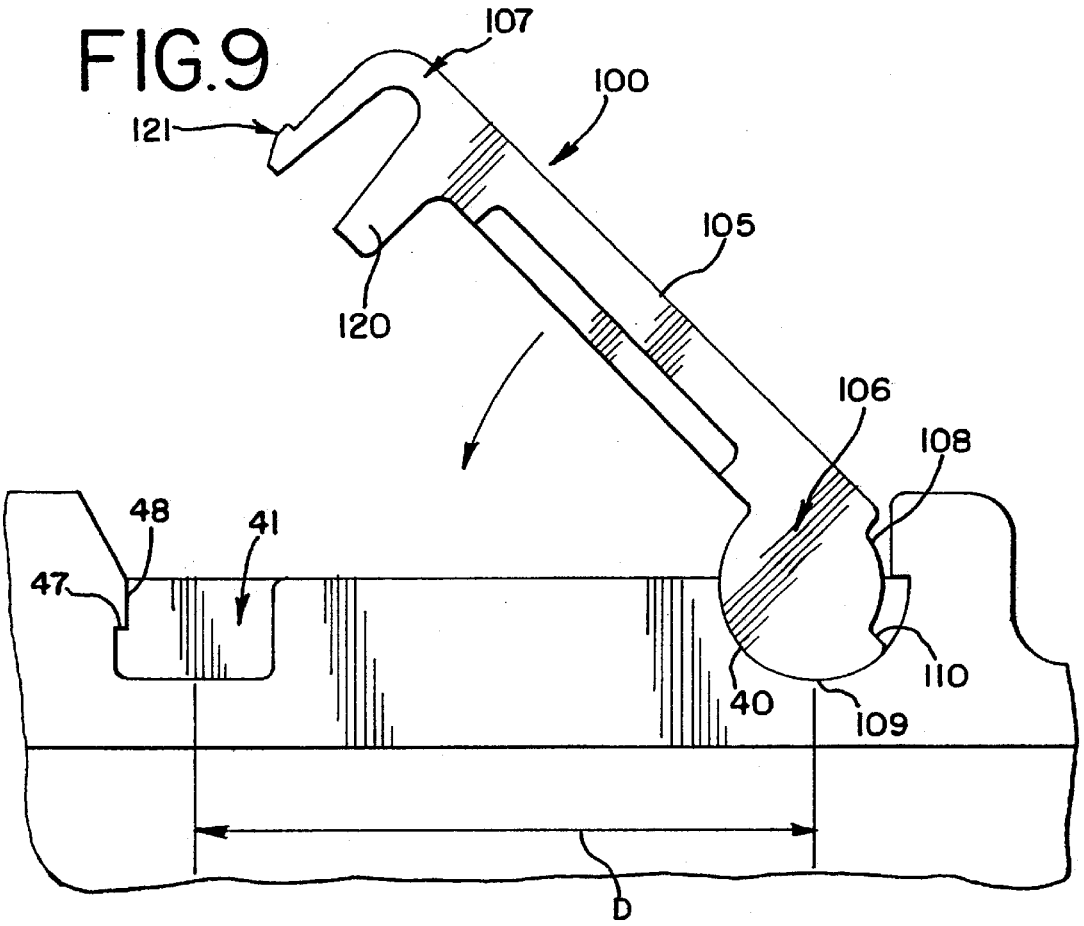
FIG. 9 is the same view as FIG. 8, but illustrating the insertion and beginning rotation of the retainer member retainer element initially inserted into the one engagement portion of the connector.
Figure 10:
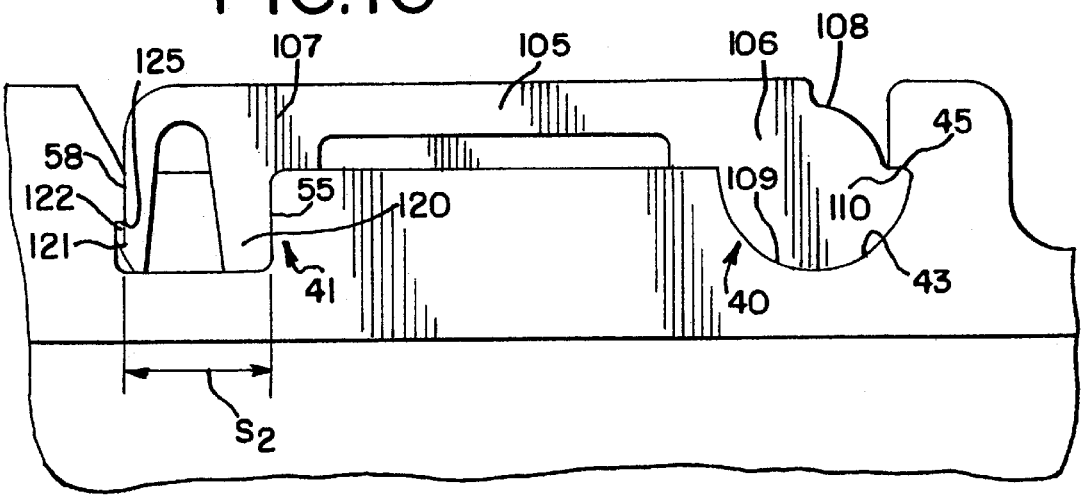
FIG. 10 is the same view as FIG. 9, but illustrating the retainer member fully engaged with the connector so that its second engagement end is engaged in the connector second engagement portions

In operation, once the pawl end 106 of the retainer member 100 is located in the first engagement cavity 40, it is rotated in a counter-clockwise direction as shown in FIGS. 6 & 9, thereby bringing the latching end 107 of the retainer member 100 into alignment with and opposition to the second engagement cavity 41. The tops 48, 59 of the sidewalls 49, 55 of the second cavity sidewalls are preferably either rounded or slanted as shown. This configuration 59 facilitates the entry of the lug member 120 of the latching end 107 into the second cavity. Likewise, the slanted surface 8 of the other sidewall 49 serves as a reaction, or cannoning surface that engages the latching member 121, and particularly the hook end 122 thereof. The hook end 122 rides upon this surface 48 which causes the latching member 121 to flex or deflect inwardly (toward the lug member 120) so that it rides along the sidewall 49. The inherent flexibility of this latching member 121 will cause the hook end 122 to spring outwardly when it reaches the undercut 57. At this orientation, the two stop surfaces 47, 125 oppose and engage each other to hold the latching end 107 in place within the second cavity 41. At the same time, the pawl end 106 of the retainer member has been rotated within the first cavity to an extent as shown in FIG. 10, where its shoulder portion 110 abuts against the first cavity stop surface 45.

It can be seen that the retainer member 100 acts as a clip to hold the individual connector elements 21 together as a unified block, or assembly 20 of connector elements. The retainer member 100 not only stiffens the block or unit of connector elements 21, but also aligns the connector elements within the block 20. In this regard, the insert and rotate action of the pawl end 106 serves to initially align the connector elements 21 lengthwise along the unit 20 of connector elements 21 (along the arrow $L_C$ in FIG. 6). This is effected by the contact of the plurality of rounded engagement ends 106 of the retainer member 100. Pairs of the engagement ends 106 will ride on the curved surfaces 43 of the first cavities 40 of each connector element 21. The curvature of the outer sections 109 of the engagement pawl 106 will serve to move individual connector elements 21 slightly forward or backward along the direction $L_C$ of the connector unit 20. This will serve to align the engagement end or terminating face of the mass 20 of connector elements 21 into a planar engagement/terminating face.

In order to align the connector elements 21 widthwise along the unit assembly 20 of connectors, each cavity 40, 41 preferably includes an alignment member, such as the lugs 60, 61 illustrated in FIGS. 2, 3 & 6. These lugs 60, 61 extend lengthwise within their respective cavities 40, 41 and are centrally disposed therein so as to present points of reference, or reaction surfaces on the connector elements 21 that may be engaged by portions of the retainer member 100. In this regard, the corresponding first and second engagement ends 106, 107 are provided with associated slots 62, 63 that are respectively disposed in the pawl and latch ends 106, 107 of the retainer member 100. These slots are best shown in FIGS. 2 and 3 and the manner in which the one slot 62 engages its corresponding lug 62 is shown best in FIG. 6. Each slot 62, 63 is disposed on the retainer member 100, typically on the underside thereof and is aligned with the centers of their opposing cavities 40, 41. The first slots 62, those disposed in the pawl engagement end 106 of the retainer member 100, will assist in aligning the pawl end 106 in the first cavities 40. Insertion of the pawl end and imposition of pressure upon it will cause the slots 62 to engage their opposing lugs 60, thereby exerting an alignment force on the connector elements 21 widthwise of the connector unit 20, or in other words, in a direction transverse to the length of the connector elements 21. Rotation of the pawl end 106 and contact of the latch end 107 with the second cavity 41 will cause a similar alignment force to be exerted on the connector elements 21 in a location that is spaced apart from the first engagement end 106 of the retainer member 100. Thus, it can be appreciated that the retainer member performs an alignment function on the connector elements 21 in two different directions which are generally transverse to each other.

The retainer members 100 have a low profile that permits them to engage the connector elements 21 along the surfaces of their body portions 22 rather than at or along their engagement end portions 70 which extend from the body portions 22 and which are received within an opposing connector 27. The opposing connector 27 typically includes two sidewalls 73, 74 that define a cavity of the connector 27 and which engage the connector elements 21, whether alone, or as a block or unit of connector elements. Because the opposing connector 27 typically has its sidewalls 73, 74 engage the block of connector elements at its engagement end portions 75 (FIG. 1.), the low profile of the retainers 100 of the invention do not require a retention shroud or a separate retainer that encompasses both the block 20 of connector elements 21 and the opposing connector 27 as in the prior art, thereby maintaining the original footprint of the opposing connector on the backplane and not sacrificing additional space thereon to support the connector block. The retainer members 100 are low profile and in essence hug the sides of the connector elements 21 at a location well above the location where the connector elements 21 engage the opposing connector 27, thereby not requiring modification of the opposing connector 27 as in the prior art.

Figure 11:
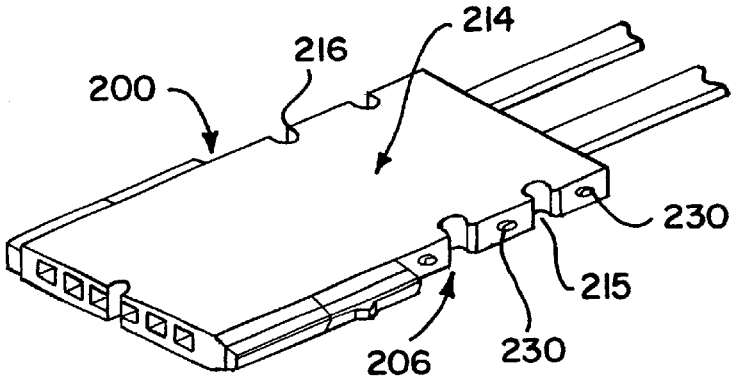
FIG. 11 is a perspective view of a wafer connector that is adapted to engage a second embodiment of the connector retainer of the invention.
Figure 12:
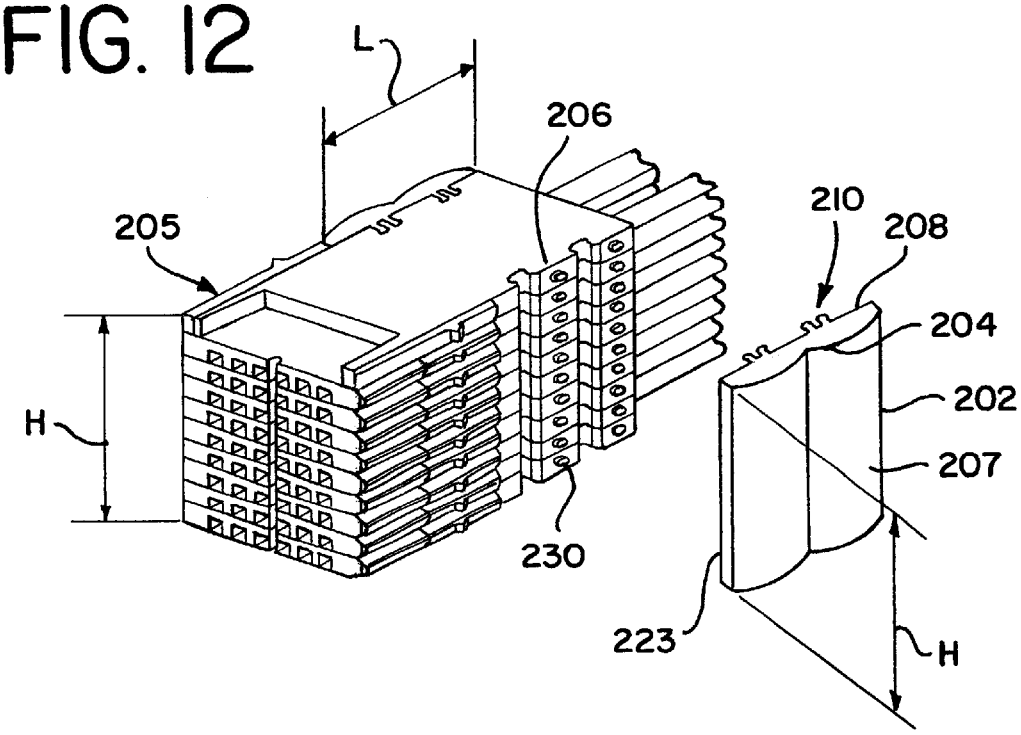
FIG. 12 is a perspective view of a stack of wafer connectors as depicted in FIG. 11, but illustrated engaged together with one retainer engaged with the stack and another retainer removed therefrom.
Figure 14:
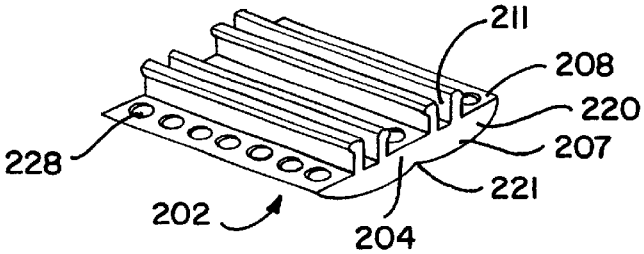
FIG. 14 is a perspective view of the wafer connector retainer of FIG. 12.

FIG. 11 illustrates a wafer connector 200 having a structure that accommodates another embodiment of a retainer 202 constructed in accordance with the principles of the present invention. This retainer 202 is illustrated in FIGS. 12 and 14. It can be seen to include a body portion 204 that has a preselected length and width that corresponds to the height (or width) H of the intended stack 205 of connectors 200 and to the length L of a retainer notch 206 formed along the side of the wafer stack 205. Preferably, the dimensions of the retainer 202 are not greater than the corresponding dimensions of the connector stack 205 and further preferably, of the retainer notch 206 that is collectively formed by all of the connectors 200. This notch 206 is set back from the overall exterior of the connector 200 that fits into an opposing connector, such as the pin header illustrated in FIG. 1. The retainer 202 fits into the notch 206 without increasing the overall exterior size of the connector stack 205.

The retainer 202 has well-defined top and bottom surfaces 207, 208 and the bottom surface 208 thereof has a plurality of engagement members 209 formed with the body portion 204 and extending therefrom. These engagement members 209 include pairs of engagement legs 210, shown extending slightly outwardly at an angle with respect to the bottom surface 208 of the retainer 202. Pairs of such engagement legs 210 that are separated by an intervening space 211 are preferred so that the legs 210 may have sufficient room in which to deflect slightly toward each other during engagement of the connector 202 with a connector stack 205. The engagement legs 210 have free ends 212 that may be considered as prongs which are either slightly enlarged as compared to the balance of the legs 210, or extend in a fashion parallel to the bottom surface 208.

Figure 15:
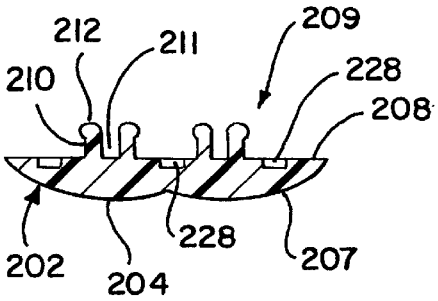
FIG. 15 is a cross-sectional view of the connector retainer of FIG. 16, taken along lines 15—15 thereof.
Figure 16:
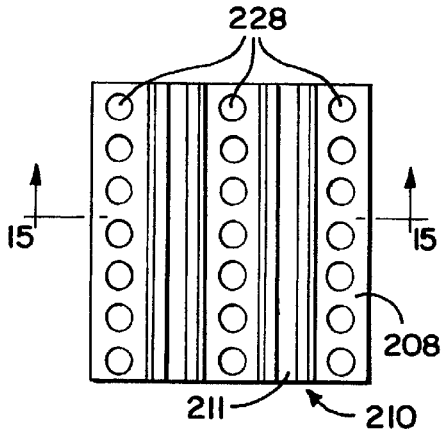
FIG. 16 is a bottom plan view of the connector retainer of FIG. 14.
Figure 17:
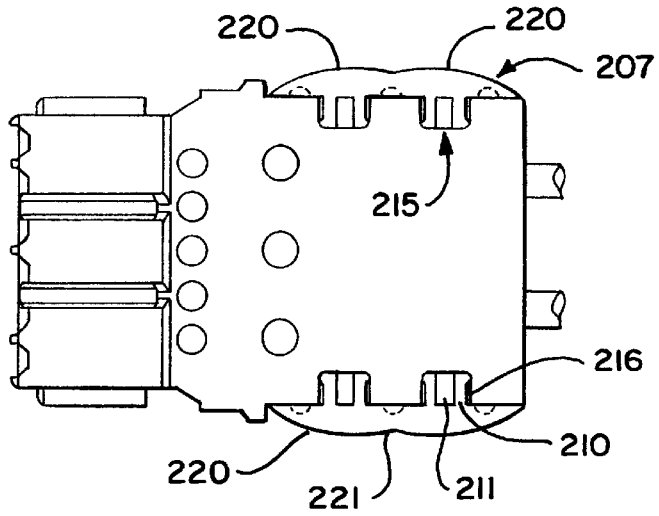
FIG. 17 is a top plan view of a stack of connector wafers with two retainers in place thereon, illustrating the manner of engagement between the two components.

As will be understood by reference to FIGS. 11 and 17, the wafer connector 200 has a body portion 214 that may have cavities, or recesses 215 formed therein in locations that correspond to the disposition of the engagement legs 210 on the retainer. These legs 210 are received within the recesses 215 and, as shown in FIG. 11, the recesses 215 may have undercut portions 216 that receive the enlarged parts, or prongs of the retainer leg free ends 212. The intervening space 211 that lies between the engagement legs 211 permits them to deflect toward each other when the legs 211 are inserted into the connector recesses 215 and the flexibility of the material from which the retainer is made, such as a plastic, causes the legs 210 to deflect upon initial insertion and then expand outwardly to the position of FIGS. 15 and 17, where they engage the side walls of the recess 215. The engagement legs 211 may extend between opposite sides of the retainer 202 as continuous rails.

The top surface 207 of the retainer 202 may be contoured in the manner shown with two slight "hills" or "peaks" 220 separated by a slight "dip" or "valley" 221. In this manner, an ergonomically pleasing exterior surface is presented to the stack 205 of connectors. The hill and valley portions 220, 221 facilitate the gripping of the stack 205 by a user in a simpler manner than is presented by the retainer shown in FIGS. 1–10. One end 223 of the retainer 202 may have the same thickness as the depth of the retainerreceiving notch 206 of the connector so that a desired width of the connector stack 205 is maintained for engagement into a pin header or other opposing connector (not shown).

Figure 13:
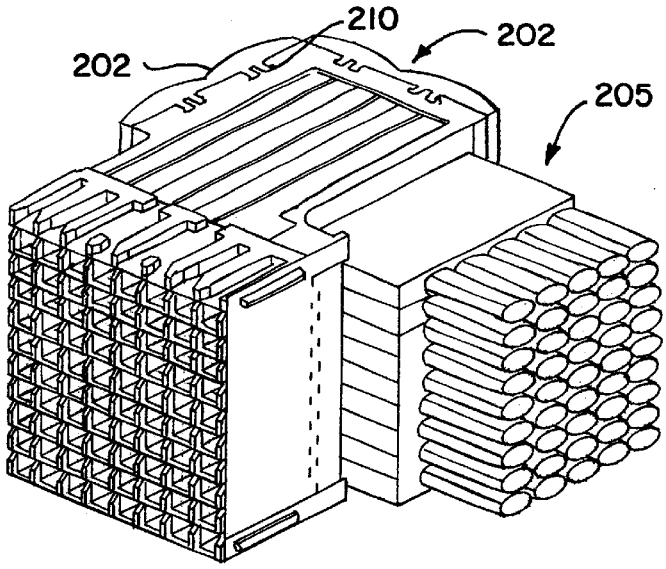
FIG. 13 is a stack of wafer connectors held together with two retainers of the type shown in FIG. 12, but the retainers engaging the stack of wafer connectors on adjacent sides thereof.

The retainer 202 may also include a series of recesses 228 formed in its bottom surface 208 (FIGS. 14 & 15) that are formed in the retainer body portion 204. The recesses 228 receive corresponding secondary engagement members formed as posts 230 on the sides of the connectors 200. These recesses 228 are spaced along the bottom surface 208 alongside the engagement legs 211, which may extend for the entire extent of the retainer 202 as continuous rails. This combination of posts and recesses serves as a secondary engagement aspect of the retainer, which will serve to align the connectors 200 along the height H of the connector stack 205, while the engagement legs 210 serve to align the connectors 200 along the length L of the connector stack 205. As shown in FIG. 13, these type retainers may be used on connector stacks along adjacent faces, or sides, of the connector stack 205, rather than along two parallel faces, or sides, as shown in FIG. 12.

Figure 18:
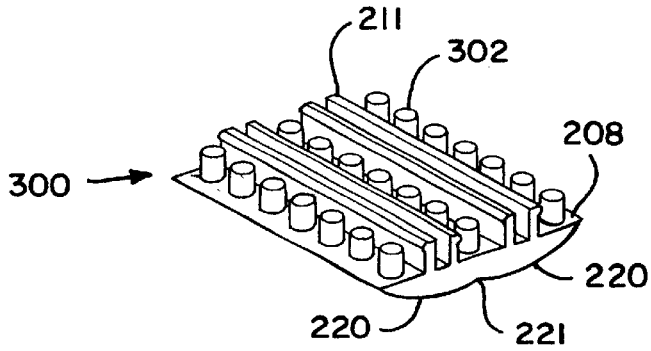
FIG. 18 is a perspective view of a third embodiment of a connector retainer constructed in accordance with the principles of the present invention and which utilizes posts as secondary engagement members; and, FIG. 19 is a perspective view of a wafer connector which is used in association with the retainer of FIG. 18.
Figure 19:
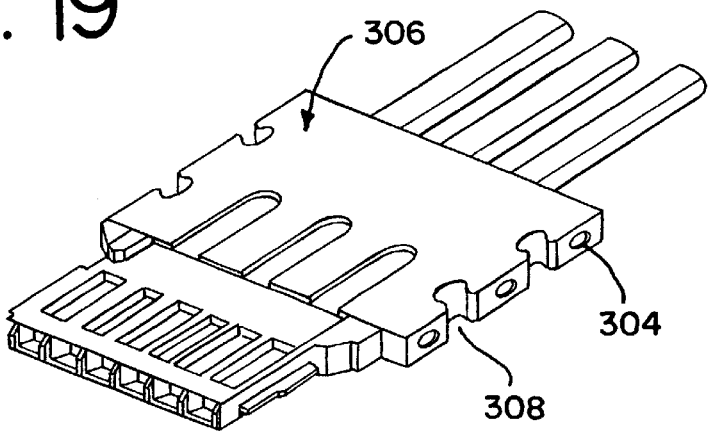

FIG. 18 illustrates another embodiment of a retainer 302 constructed in accordance with the principles of the present invention. In this embodiment, the retainer 300 has posts 302 that extend up from the bottom surface 208 thereof, and which flank the engagement legs 211. These posts 302 are received within corresponding recesses 304 of comparable connectors 306. The recesses 304 are formed in hand portions 307 of the connectors 306 that flank the engagement leg-receiving grooves 308 of the connectors 306.

While the preferred embodiment of the invention have been shown and described, it will be apparent to those skilled in the art that changes and modifications may be made therein without departing from the spirit of the invention, the scope of which is defined by the appended claims, such as the pawl surfaces may not need to be completely circular in their curved extent, the secondary engagement members need not be circular posts and lugs.

We claim:

1. A connector assembly comprising:

a plurality of individual connector elements, each of the connector elements including a connector body portion, each connector body portion having a plurality of distinct sides, said individual connector elements being arranged in a block of connectors in side-by-side order such that said distinct sides of said connector body portions of said individual connector elements cooperatively define distinct sides of said block of connectors, each of the individual connector elements further including a plurality of cables extending from a first one of said connector element body portion sides, and a plurality of conductive terminals disposed along a second of said connector element body portion sides, said terminals being electrically connected to said cables, and each of said individual connector elements further including first and second recesses formed along a third side thereof and spaced apart from each other in a preselected spacing;

at least one retainer for retaining said connector modules together as said block of connectors, the retainer having a body portion with a distinct engagement surface, the retainer body portion having a predetermined width that is no greater than a corresponding width of said block of connectors, said retainer further including at least first and second engagement members that extend for approximately said width of said body portion and which extend out from said engagement surface, the retainer first and second engagement members being spaced apart from each other in a preselected spacing that matches said preselected spacing between said connector element first and second recesses, said first and second engagement members being respectively insertable into and removable from said connector element first and second recesses, said first and second engagement members holding said individual connector elements together as a block when said retainer is engaged with said connector elements.

2. The connector assembly of claim 1, wherein said retainer first and second engagement members are continuous rails and wherein said connector element first and second recesses form continuous first and second recesses when said connector elements are assembled into said block.

3. The connector assembly of claim 1, wherein said retainer first and second engagement members are respectively disposed along first and second edges of said retainer.

4. The connector assembly of claim 1, wherein said retainer first and second engagement members include pairs of engagement legs.

5. The connector assembly of claim 4, wherein said connector element first and second recesses include undercut portions and said retainer engagement legs have enlarged free ends that extend into said undercut portions when said retainer is engaged with said connector elements.

6. An assembly of connector modules that is insertable into and removable from a corresponding opposing connector as a unit, comprising:

a plurality of connector modules, each of the connector modules including a plurality of conductive terminals housed in an insulative housing, said connector modules being stackable upon each other to form a unit of connectors, each of said modules having a mating end at which said conductive terminals are exposed for engagement with opposing terminals of said opposing connector, and a termination end at which a plurality of wires enter said connector modules, said connector modules each having pairs of engagement cavities disposed in said body portions thereof at locations such that said engagement cavities collectively form two continuous grooves in a uni of combined connector modules along a single side of said unit, the two grooves being separated from each other by a first preselected distance; and, a connector retainer for retaining said connector modules together in said unit, the retainer including a body portion with distinct first and second faces, the retainer first face defining an engagement face that engages said connector modules and retains said connector modules together as a unit, the retainer second face forming an exterior gripping surface of said connector module unit when said retainer engages said connector modules, said retainer including a pair of engagement legs disposed on said first face in opposition to said connector modules and spaced apart from each other said preselected distance such that said engagement legs oppose said connector cavities, said retainer engagement legs being insertable into and removable from said connector cavities, said retainer engagement legs aligning said connector modules when said retainer is engaged with said connector modules.

7. The connector assembly of claim 6, wherein said connector module engagement cavities are disposed in said unit between said mating and termination ends thereof.

8. The connector module assembly of claim 6, wherein said connector modules each include a notch disposed along one common edge thereof that together form a collective notch of said connector module unit when said connectors are assembled together, said grooves being disposed within said notch and said retainer fitting within said notch.

9. The connector assembly of claim 8, wherein said retainer abuts said common edge of said connector modules.

10. The connector assembly of claim 6, wherein said connector modules further include a plurality of posts disposed on at least one side edge thereof, and said retainer includes a plurality of recesses disposed along said retainer first face, said posts being received within retainer recesses when said retainer is engaged with said connector module unit.

11. The connector module assembly of claim 10, wherein said posts and recesses align said modules together in one direction and said grooves and engagement members align said connector modules in another direction within said connector module unit.

12. The connector assembly of claim 6, wherein said connector modules further include a plurality of recesses disposed along one side edge thereof and said retainer includes a like plurality of posts disposed along said retainer first face, said retainer posts being received within said connector module recesses when said retainer is engaged with said connector module unit.

13. The connector module assembly of claim 12, wherein said posts and recesses align said connector modules together in one direction and said grooves and engagement members align said connector modules in another direction within said connector module unit.

* * * * *